United States Patent [19]

White

[11] Patent Number: 4,637,934

[45] Date of Patent: Jan. 20, 1987

[54] LIQUID CONTAINER WITH INTEGRAL OPENING APPARATUS

[75] Inventor: Leonard A. White, Gurnee, Ill.

[73] Assignee: Baxter Travenol Laboratories, Inc., Deerfield, Ill.

[21] Appl. No.: 599,426

[22] Filed: Apr. 12, 1984

[51] Int. Cl.[4] ..... A61J 9/00; A61J 11/00; B65D 27/32

[52] U.S. Cl. ..... 426/117; 426/115; 426/124; 426/123; 215/11 R; 215/11 C; 215/11 E; 206/603; 604/408; 604/411; 604/415; 222/83; 222/105

[58] Field of Search ..... 426/117, 115, 394; 222/83, 89, 80, 81, 82, 83.5, 86, 88, 105, 92, 107, 211; 383/79, 80; 215/11 R, 11 B–11 E, 2, 33, 266; 206/219, 221, 222, 603; 604/415, 411, 412, 408–410, 414

[56] References Cited

U.S. PATENT DOCUMENTS

| | | | |
|---|---|---|---|
| 1,109,110 | 9/1914 | Clark | 222/92 |
| 1,927,605 | 9/1933 | Fiore | 222/92 |
| 2,596,592 | 5/1952 | Parker | 222/92 |
| 2,807,384 | 9/1957 | Lipari | 426/117 |
| 2,813,649 | 11/1957 | Lipari | 426/117 |
| 2,849,321 | 8/1958 | Lhermitte et al. | 206/603 |
| 3,255,923 | 6/1966 | Soto | 604/262 |
| 3,266,910 | 8/1966 | Barndy | 222/89 |
| 3,276,632 | 10/1966 | Stanzel | 222/83.5 |
| 3,474,936 | 10/1969 | McDonnell | 222/211 |
| 3,523,026 | 8/1970 | Emerson | 426/117 |
| 3,563,413 | 2/1971 | Gordon | 222/83.5 |
| 3,596,801 | 8/1971 | Barnack | 222/81 |
| 3,636,950 | 1/1972 | Gomez et al. | 206/222 |
| 3,756,390 | 9/1973 | Abbey et al. | 222/80 |
| 3,774,812 | 11/1973 | Lemelson | 222/211 |
| 3,779,413 | 12/1973 | Pickerell et al. | 426/117 |
| 3,802,604 | 4/1974 | Morane et al. | 222/83 |
| 3,871,542 | 3/1975 | Hammer | 215/11 E |
| 3,970,068 | 7/1976 | Sato | 206/222 |
| 3,987,791 | 10/1976 | Chittendon et al. | 222/83 |
| 4,198,972 | 4/1980 | Herb | 604/408 |
| 4,265,374 | 5/1981 | Sebalos | 222/105 |
| 4,365,629 | 12/1982 | Pert et al. | 604/408 |
| 4,412,623 | 11/1983 | Schmidt | 215/11 C |
| 4,469,249 | 9/1984 | Malpas | 222/83 |

*Primary Examiner*—Steven Weinstein

*Attorney, Agent, or Firm*—John J. Ryberg; John P. Kirby; Paul C. Flattery

[57] ABSTRACT

An improved disposable liquid container adapted for infant nursing is provided for maintaining nursing liquid in a sterile or aseptic condition until dispensed therefrom. Rigid penetrating means carried by a semirigid support member penetrate a compartment closing diaphragm to allow nursing liquid to flow from the compartment to a communicating, attached nipple. The semirigid support member is integral with the liquid compartment and substantially preserves its shape as the fluid is dispensed therefrom. Flexible walls of the container are allowed to collapse together as the fluid is dispensed to prevent excessive ingestion of air by a nursing infant. The attached nipple is maintained in a clean, uncontaminated, sterile, or aseptic condition until use by means of separable sealing tabs or a discardable cover. Additional embodiments provide a flexible container which may safely be placed upright on cannula adjacent said generally sharpened tip portion to allow fluid to flow through said flow passageway when said tip portion penetrates said penetrable means.

18 Claims, 11 Drawing Figures

FIG. 1
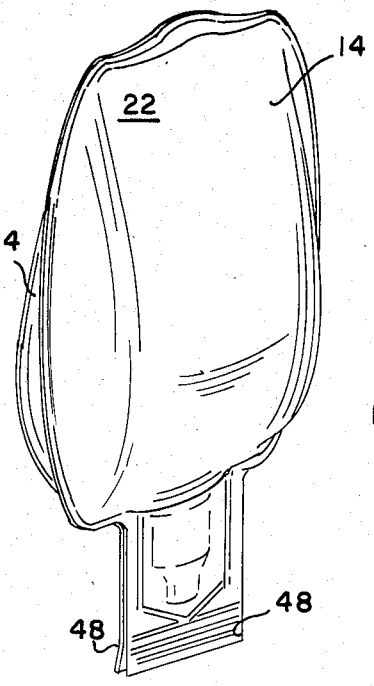
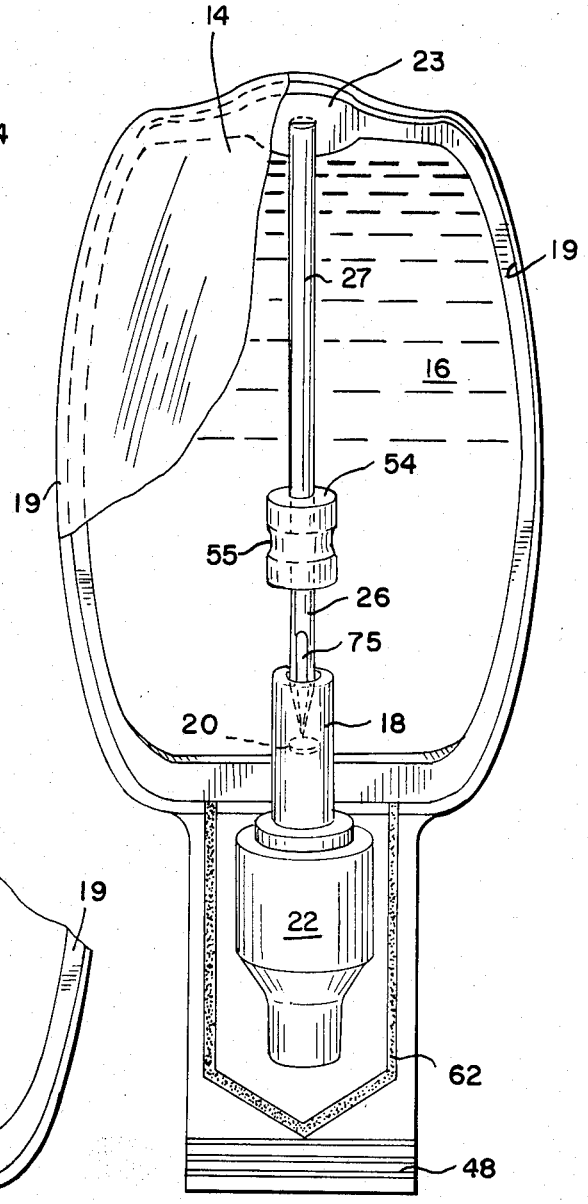
FIG. 2
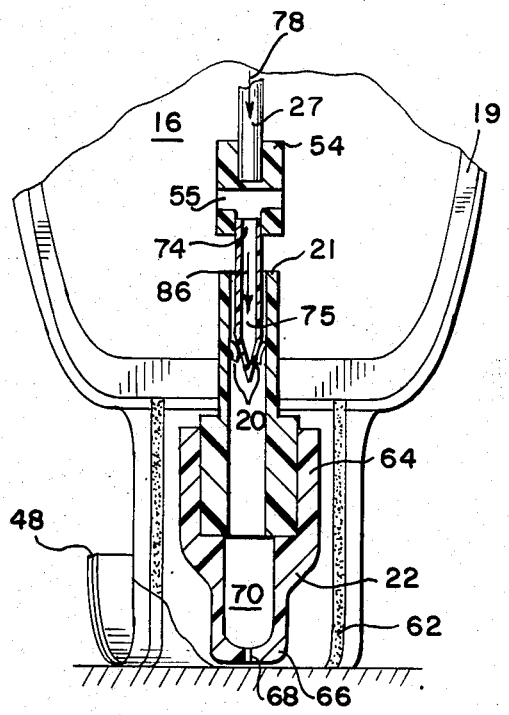
FIG. 3

FIG. 4
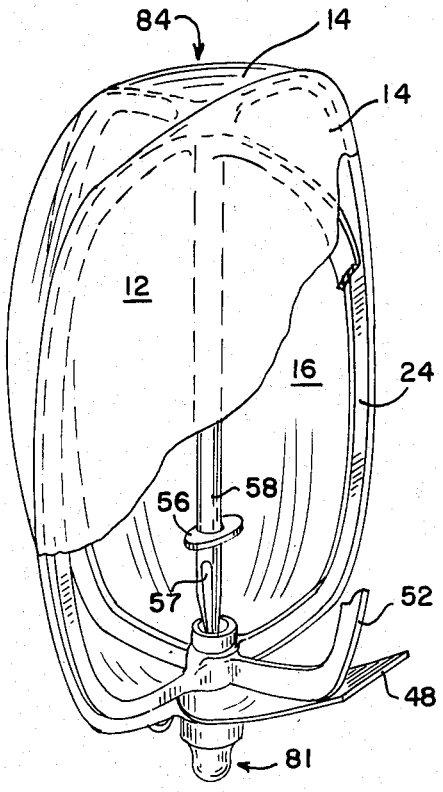
FIG. 5
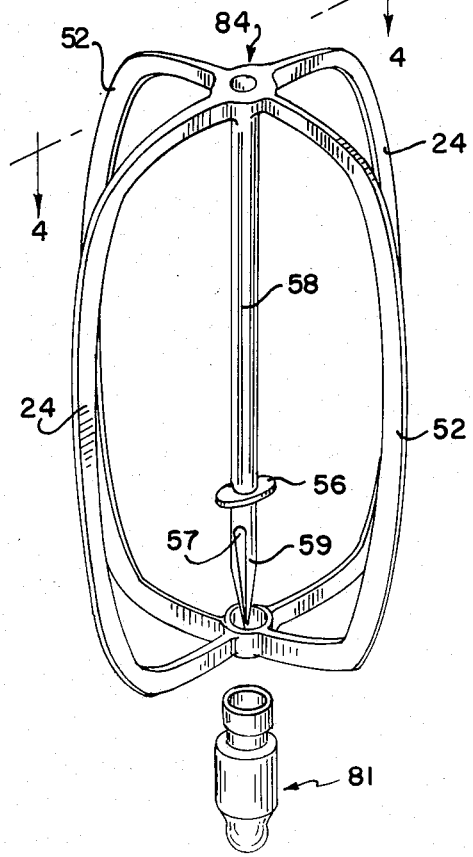
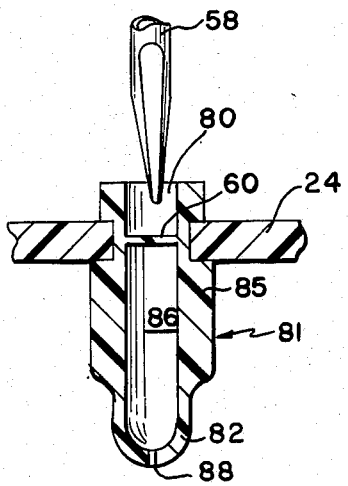
FIG. 6
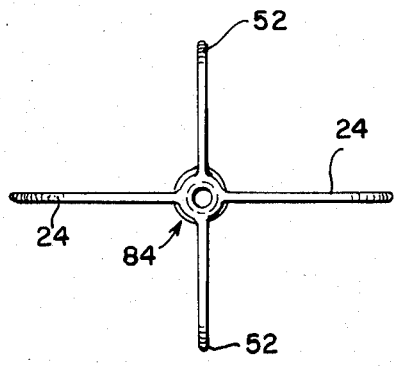
FIG. 7

FIG. 8
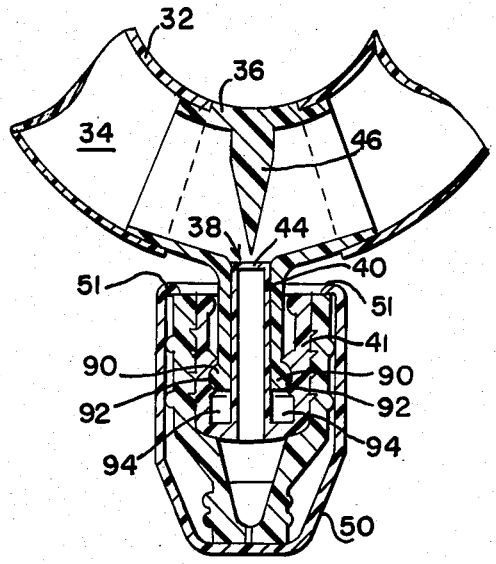
FIG. 9
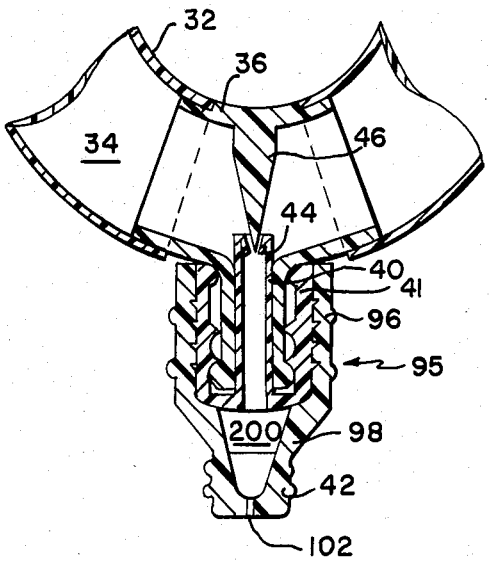
FIG. 10
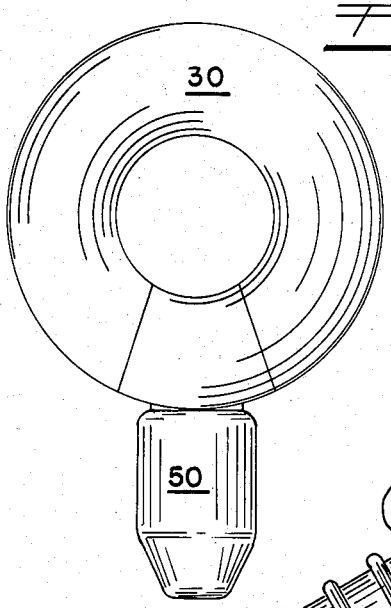
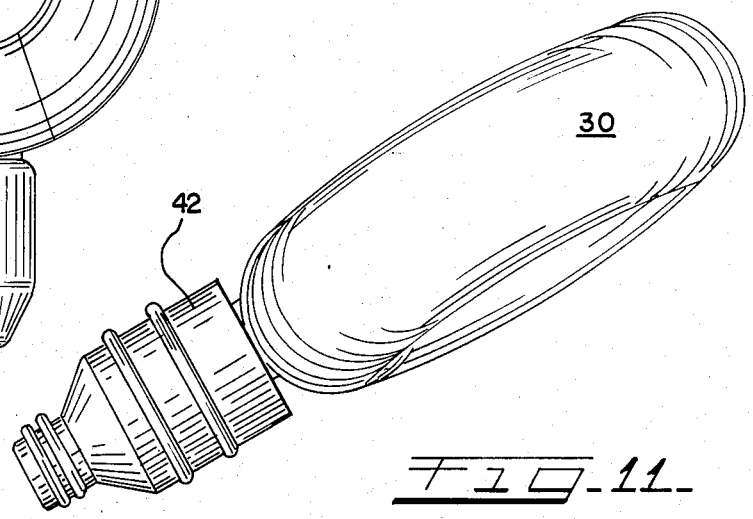
FIG. 11

LIQUID CONTAINER WITH INTEGRAL OPENING APPARATUS

The present invention relates generally to disposable liquid containers. More particularly, it relates to flexible, disposable nursing containers having integral opening apparatus.

Nursing containers for infants have been known in a wide variety of shapes and configurations. Perhaps the classic of these is the well known "baby bottle", which involves a glass or plastic bottle closed at the end by a nipple and threaded ring. Although still in widespread use, the classic glass or plastic bottle has numerous shortcomings. It is relatively heavy and bulky, increasing shipping and storage cost. Unless prefilled and sterilized, it usually requires filling on an "as-needed" basis, and, if to be reused, requires sterilization. A further and perhaps the most significant drawback with such containers is the need for entry of displacement air for dispensing of the contents, which often results in leaky or inoperative nipples, and increases the risk of air ingestion by the infant. Although such nursers have been provided pre-filled and sterilized, which is highly desireable for hospital, clinical and other institutional applications, as depicted for example in U.S. Pat. No. 3,838,784 to Barton and Herron, the remaining drawbacks still exist.

A more recent development in infant nursers utilizes a disposable plastic liner and a reusable holder. The liner is open at one end for securing to the holder, and is held in place by a resilient nipple which overfits the end of the holder and the liner. While not requiring displacement air for dispensing the contents, this type of nurser, requires substantial manual assembly by the user, which must be done on an "as-needed" basis because of the lack of sterility—both of which are particularly undesirable in an institutional setting such as a hospital or clinic.

Other proposed nursers, of which U.S. Pat. No. 3,117,874, issued Jan. 14, 1984 to Horan is illustrative, suffer from the same drawbacks. Namely, fluid must be introduced into the nursing container by the user; and the nipple must be directly handled by those using the container or is unduly exposed to damage or contamination during shipping and storing of the container. Additionally, when the flexible container loses its shape as the liquid is sucked from it by the nursing infant, the particular quantity of liquid remaining in the container may be difficult to read accurately, fluid may be trapped in folds within the container and not be dispensed to the infant or the container may become awkward for the user or infant to hold.

Accordingly, it is a general object of the present invention to provide a nursing container which does not suffer from the drawbacks described above.

It is a further object of the present invention to provide a pre-filled and pre-sterilized or aseptic nurser which requires a minimum of effort in preparation by the user and maintains the nursing fluid and dispensing nipple in a sterile or aseptic condition until use.

It is yet a further object to provide a nursing container which does not require displacement air for dispensing contents, yet maintains the container in an overall non-collapsed configuration.

The present invention provides an improved liquid container for maintaining a liquid in a sterile or aseptic condition until dispensed therefrom. It further provides an improved nursing container for use in the home or health care setting in which both the nursing fluid and the nursing nipple are maintained in a sterile or aseptic condition until use. Additionally, the present invention provides an integral support apparatus for preserving the general shape of the nursing container while the fluid is being dispensed, without sacrificing the beneficial qualities typically associated with flexible dispensers such as preventing substantial amounts of air from being ingested by the suckling infant.

Several embodiments of the present invention are disclosed herein. One ill.ustrated embodiment utilizes the present invention in shapes easily managed by the infant such as the typical pacifier shape. Another embodiment having additional support members provides a self-supporting and stand-up nursing container which may be set upright on a countertop or other flat surface without fear of tipping.

More particularly, the fluid within the container is maintained in a sterile or aseptic condition until use by filling the container with the desired fluid under sterile conditions at a factory or other suitable location and aseptically sealing the container or, if desired, by sterilizing the container at the factory after filling. Outside contamination is further prevented by including an integral opening apparatus within the sealed container so that it is opened from the inside without the introduction of any outside matter during the opening process. In one embodiment of the present invention, this opening apparatus is a generally elongated spike which is carried within the container and used to rupture a sealing membrane when the container is to be used. The container is opened simply by axially compressing the container which drives the internal spike through a sealing membrane.

A modification of this embodiment provides a semi-rigid support member within the container. The puncturing spike is carried by this semirigid member and is axially driven to puncture the sealing membrane in response to end-to-end flexure of the semi-rigid support member.

In another embodiment of the present invention, the container is opened by forcing the sealing membrane into engagement with the spike to cause the membrane to rupture. Pressure is applied to the nipple to cause the sealing membrane, which is carried by the nipple, to move inwardly and rupture.

In accordance with a further aspect of the present invention the nipple is enclosed by tab-like extensions of the flexible container walls which define the liquid compartment. These maintain the nipple in sterile or aseptic condition during shipping and storing, but for use may be simply separated along separable seals to expose the nipple. In another embodiment, a rigid cover is secured on the nipple which is removed only after the container has been opened to allow liquid to reach the nipple.

These and other objects and advantages of the present invention are set forth more specifically and are more fully understood when taken in conjunction with the accompanying description and figures of the preferred and alternative embodiments of the present invention, of which:

BRIEF DESCRIPTION OF THE DRAWINGS

FIG. 1 is a perspective view of the nursing container according to one embodiment of the present invention;

FIG. 2 is a cut-away view of the container of FIG. 1 showing the integral opener and nipple assembly, with the container closing membrane intact;

FIG. 3 is a cross-section of the opener and nipple assembly with the opener in a penetrating state rupturing the closing membrane to allow fluid to flow to the nipple;

FIG. 4 is a cut-away view of a self-supporting, stand-up container according to another embodiment of the present invention with the nipple sealing tabs being fully peeled back to expose the nipple;

FIG. 5 is an illustration of the right angle support members of the stand-up container of FIG. 4;

FIG. 6 is an enlarged cross-section view similar to FIG. 3 and having the container closing membrane within the nipple assembly still being intact;

FIG. 7 is a view from the base of the right angle support members of FIG. 5;

FIG. 8 is a cross-section of a pacifier-style nursing container according to another embodiment of the present invention showing the opener and container closing membrane in selectively separated positions;

FIG. 9 illustrates the pacifier-style nursing container of FIG. 8 in an open position with the opener penetrating the container closing membrane to allow liquid to flow to the now exposed nipple;

FIG. 10 is a side view of the complete pacifier-style nursing container of FIG. 8; and FIG. 11 is a perspective view of the pacifier style nursing container of FIG. 8 having the nipple cover removed.

The present invention is generally embodied in a flexible liquid container 12 having flexible walls 14 which define an internal liquid compartment 16 for containing a liquid particularly suitable for infant feeding. The container 12 further comprises means defining an access passageway 18 which is normally closed by penetrable means such as a diaphragm 20 and communicates with dispensing means such as nipple 22. A rigid penetrating means such as spike 26 within the compartment 16 is disposed and aligned with the access passageway 18 to penetrate diaphragm 20 upon compression of container 12 to allow liquid from compartment 16 to flow to nipple 22. Preferably, one end of the spike support rod 27 is captured between the container walls at the sealed periphery 19, and the other end extends partially into access tube 21 which is sealed by diaphragm 20. Alternatively, a separate semi-rigid support member 24 may be disposed at least partially along the periphery of flexible walls 14 to further sustain the overall product shape while permitting the walls 14 to collapse together upon dispensing of the liquid from the compartment 16.

In another embodiment of the present invention, a toroidal-shaped container 30 may be defined by a generally elongated tubular flexible member 32 which forms a generally donut-shaped internal compartment 34 having a semi-rigid support member 36 disposed therein. Access to compartment 34 may be had via fluid conduit 38 which contains slidable inner sleeve 40 having penetrable means such as diaphragm 44 normally closing fluid communication between compartment 34 and a dispensing means or nipple 42. The diaphragm 44 may be ruptured to access the contents by a rigid penetrating member such as spike 46 carried by semi-rigid support member 36. Sliding movement of inner sleeve 40 toward spike 46 causes the spike to rupture the diaphragm thereby allowing fluid to flow from compartment 34 to nipple 42.

Additionally, the dispensing means or nipple 22 may be enclosed by sealing tabs 48 (FIGS. 1–4) or cover 50 (FIG. 8). Also, an additional semi-rigid support member 52 may be disposed in compartment 16 (FIG. 4) to allow container 12 to be placed in a self-supporting upright position on a flat surface, and penetration limiting means 54 (FIG. 2) may be carried by rigid penetrating means 26 to limit the penetration of penetrable means 20 by rigid penetrating means 26. Similarly, penetration limiting means 56 may be carried on one-piece rigid penetrating means 58 of an alternative embodiment depicted in FIG. 5 to limit the penetration of penetrable means 60 by rigid penetrating means 58.

More particularly, FIG. 1 shows a flexible nursing container 12 defined by a pair of flexible walls 14 joined along their peripheral edges and including integral extensions forming sealing tab portion 48 for enclosing a dispensing means such as nipple 22. The flexible walls 14 are preferably of plastic material which may be heat-sealed or otherwise bonded together around the peripheral edge 19. Various plastics, such as polyethylene or polypropylene or polyvinylchloride, may be used for the container walls, provided they are inert to the contents. The flexible walls also may be made of a single layer of plastic material or may be a laminate of various materials. If the container is not enclosed in an over-pouch or package which prevents oxygen transmission, the walls 14 preferably include a layer of oxygen barrier material such as Saran plastic of the Dow Chemical Co. which substantially prevents transmission of oxygen to container contents, thereby providing improved shelf life.

As illustrated by the cut-away view of FIG. 2, the walls 14 define an internal compartment 16 for containing liquid and have integral extending portions that form the sealing tabs 48 which are joined together along separable seal lines 62 and enclose the dispensing means. The dispensing means in the nursing container embodiments of FIGS. 2 and 3 is a nipple 22, and comprises a base portion 64, a flexible dispensing portion 66 having a dispensing hole 68, and a fluid communication channel 70 connecting base 64 and flexible dispensing portion 66. Nipple 22 may be fabricated from any suitable thermoplastic elastomeric material.

Nipple 22 may be bonded to container 12 at the outlet end of access passageway 18 by a suitable sealing process or, alternatively, nipple 22 may be secured to access passageway 18 by a liquid-tight friction fit or other suitable sealing means.

In the embodiment illustrated in FIGS. 2 and 3, the access passageway 18 is provided by a hollow, elongated plastic tube 21 which is sealed between flexible walls 14 at one end of the compartment 16. The tube 21 is axially aligned with spike 26 to allow it to pierce diaphragm 20 when container 12 is compressed.

In the embodiment shown in FIGS. 2 and 3, the spike 26 is secured to supporting rod 27 by means of collar 54 which limits axial penetration of spike 26 into tube 21. The other end of the support rod 27 is bonded between walls 14 at the base end of the container (opposite the nipple end). As best seen in FIG. 2, the seal area between walls 14 is enlarged at the area 23 where the support tube is bonded. The spike collar and support rod are preferably made of any suitable rigid plastic. Also, as described in more detail in connection with FIGS. 4 and 5, the spike and support rod may be a single piece instead of two pieces joined by a collar.

Because the spike 26, support rod and collar are typically secured within the container during the fabrication process and aligned for movement axially within the access passageway 18, and because the entire fabrication and filling process is completed under aseptic conditions at a processing plant or subject to post-filling sterilization, the spike 26 will be maintained in the same sterile or aseptic condition as the nursing fluid contained in compartment 16. When it is desired to dispense this sterile or aseptic fluid, the container may be axially compressed or flexed to cause spike 26 to penetrate diaphragm means 20 and allow fluid to flow from compartment 16 to nipple 22. This may be achieved easily by pressing the container 12 against a firm surface near the base of the support rod, or the container may be compressed between the hands of the person administering the fluid to the infant.

Upon rupture of the diaphragm, nursing liquid flows into the hollow spike through a lateral access port 55. Thus, even if spike 26 remains in a penetrating position through penetrable means 20 as shown in FIG. 3, fluid from compartment 16 may flow readily in the collar 54. The liquid flows through a center passageway 74 in the spike and exits the spike through elongated end apertures or passageways 75 in the puncturing end of spike 26 to the nipple 22 as shown by arrow 76. Flow passageway 74 typically comprises an axially elongated hollow passageway within spike 26 which extends from about the tip of spike 26 back toward collar 54. The length of flow passageway 74 is sufficient to allow fluid to flow freely therein. Likewise, the depth or inside dimension of flow passageway 74 is sufficient to facilitate free flow of fluid therein. Alternatively, flow passageways in the form of one or more elongated channel-like passageways may be provided in the surface of spike 26 so that liquid may flow directly to the nipple without passing through the collar.

Referring again to FIG. 3, arrow 78 is illustrative of the direction of movement of spike 26 through diaphragm means 20. As explained above, it will be appreciated that movement of the diaphragm means 20 in the opposite direction of arrow 78 toward spike 26 will result in the same effect, i.e. opening of the fluid passageway 18.

Once spike 26 has penetrated diaphragm 20 to allow fluid to flow readily through access passageway 18 to nipple 22, it is desired that the axial movement of spike 26 in access passageway 18 be limited so as not to damage nipple 22. This is shown in FIGS. 2 and 3 by a penetration limiting collar 54. The axial placement of penetration limiting collar 54 on spike 26 is dictated by the desired limitation of axial movement by spikes 26 in access passageways. It will be appreciated from the configuration illustrated in FIG. 3 that this distance is limited by the location of the diaphragm 20 within access passageway 18 with respect to the flexible length of the dispensing portion 66 of nipple 22.

An alternative embodiment of container 12 is illustrated in FIGS. 4–7. Many of the features, and functions of this alternative embodiment are similar to those described above in conjunction with the embodiment of FIGS. 1–3. However, several modifications of the basic container of FIG. 1 are illustrated in the embodiment of FIGS. 4–7.

In particular, the embodiment of FIG. 4 employs a semi-rigid support member 24, which may take the shape of a rib disposed along the periphery of walls 14 which have been joined to form compartment 16. Semi-rigid support member 24 serves to maintain the general shape of flexible container 12 as the liquid is dispensed. It will be appreciated from the configuration shown that as liquid is sucked from the compartment 16 by a nursing infant, the flexible walls 14 will collapse together to permit dispensing of the contents without requiring displacement air. However, because of the support of semi-rigid support member 24, walls 14 will only collapse inwardly and the container 12 will retain its general elongated oval shape. In this fashion container 12 may still be easily grasped by the infant or a person feeding the infant. Further, liquid will flow evenly from the compartment 16 and will not be trapped in folds which may develop if walls 14 were allowed to collapse unevenly.

Semi-rigid support member 24 is rigid to the degree that the container is maintained generally in its original shape. However, the semi-rigid member is sufficiently flexible to be able to flex to allow rigid penetrating means such as spike 26 to pierce the diaphragm 20. Semi-rigid support member 24 may be fabricated from any suitable plastic material inert to the container contents.

It may be desired that a nursing container according to the present invention be sufficiently self-supporting that it may be placed upright on a flat surface such as a bedside table. This may be accomplished, as shown in FIGS. 4 and 5, by additional rib-shaped semi-rigid support members 52 in right angle communication with semi-rigid support members 24. It will be appreciated that this gives greater definition to walls 14 of container 12 and will allow the container 12 to be placed upright with base portion 84 on a flat surface. Base portion 84 has an expanded area compared to base portion 23 of the container of FIG. 2 and is more readily adapted to support the container of FIG. 4 in an upright position. This is shown more clearly in FIG. 7 which illustrates an end view from the base section 84 of the nursing container of FIGS. 4 and 5 adapted to be placed upright on a flat table surface. This illustrates the right angle configuration of semi-rigid support members 24 and 52 shown in the container of FIG. 4.

As mentioned above, nipple 22 comprises a base portion 64, a flexible upper portion 66, and a fluid communication channel 70. It may, of course, be desirable to use a different nipple assembly depending upon the various needs of any particular application for nursing container 12. Nursing container 12 is readily adaptable for use with a different nipple assembly such as that illustrated in FIGS. 4, 5 and 6. Specifically, nipple assembly 81 (shown in those Figures) has a flexible upper portion 85 secured to semi-rigid support member 24, a flexible dispensing end portion 82, and a fluid communication channel 86 for connecting base portion 85 with flexible upper portion 82. Base portion 85 is sealed between flexible walls 14. Also shown in FIG. 6 is a dispensing aperture 88 in flexible dispensing end portion 82. Like nipple 22 disclosed in FIGS. 2 and 3, nipple 81 is fabricated from a suitable elastomeric material such as thermoplastic rubber. Additionally, nipple 81 may be joined to support member 24 and 52 by a snap fit joint as illustrated in FIG. 6.

FIG. 5 illustrates an alternative embodiment of the rigid penetrating means shown as a one-piece spike 58 secured to base portion 84. Like spike 26 and support rod 27, spike 58 is generally elongated and has a pointed tip portion 59 adapted to penetrate diaphragm 60. Also, a flow passageway 57 is disposed within spike 58 to allow ready flow of fluid from compartment 16 to nipple 81 even when spike 58 is in a penetrated position with respect to diaphragm 60 and extends from about the tip to about collar 56 which is secured to spike 58. Flow passageway 57 provides for ready fluid flow once diaphragm 60 has been punctured in any of the ways described in conjunction with passageways 74 and 75 in spike 26 and may provide for fluid communicaton with an access port located past collar 56. Collar 56 may be a plastic washer which has been secured to spike 58 to limit its axial penetration of flow passageway 80.

A further embodiment of the present invention is illustrated in FIGS. 8–10. It is sometimes desired that a nursing container be supplied in different shapes and sizes which may be more readily adaptable to different situations. For example, when traveling in an automobile, the nursing container 12 of FIGS. 1 and 4 or a classic nursing bottle may not be as convenient as the pacifier style nursing container 30 illustrated in FIGS. 8–11. Specifically, that container is defined by a long tubular flexible member 32 joined at its ends to define an internal compartment 34 having a semi-rigid support member 36 disposed therein. Penetrating means such as spike 46 is carried by semi-rigid support member 36 and aligned to penetrate penetrable means such as diaphragm 44 upon movement of fluid communication means such as inner sleeve 40 toward spike 46. Movement of inner sleeve 40 toward spike 46 may be accomplished by sliding the dispensing means 42 secured to inner sleeve 40 along outlet conduit 38 to cause detents 90 to move from indents 92 to indents 94. This movement may be more fully appreciated by contrasting FIGS. 8 and 9. FIG. 9 illustrates the ruptured state of diaphragm 44 which allows fluid to flow readily from compartment 34 to dispensing means 42.

More specifically, semi-rigid support member 36 of FIGS. 8 and 9 is a hollow, arcuate member which is sealed between the ends of the flexible tubular member 32. It further comprises an integral flow conduit 38 which provides an outlet for communicating with internal compartment 34. A nipple assembly 95 is slideably attached to flow conduit 38 by means of generally elongated inner sleeve 40 and outer sleeve 41 which are spaced to receive flow conduit 38 therebetween for axial movement of inner sleeve 40 within flow conduit 38. Nipple assembly 95 is further secured to flow conduit 38 by means of detents 90 carried by flow conduit 38 and indents 92 and 94 disposed within outer sleeve 41. Inner sleeve 40 also carries a diaphragm 44 which closes fluid flow through inner sleeve 40 when detents 90 are disposed within indents 92. However, in response to axial pressure, nipple assembly 95 may be forced inward causing detents 90 to be moved into indents 94 and diaphragm 44 to be pierced by spike 46. When diaphragm 44 has been ruptured by spike 46, fluid communication is possible between compartment 34 and nipple 42 which is mechanically secured to outer sleeve 41. Nipple 42 may of course be secured by means other than the mechanical connection of FIGS. 8 and 9.

As mentioned above, although not shown in FIG. 9, spike 46 includes a flow passageway disposed therein to allow fluid to flow readily through spike 46 when it has ruptured diaphragm 44, and this allows fluid to reach nipple 42.

The dispensing means of FIGS. 8 and 9 comprise a nipple assembly 42 having a base portion 96 and a flexible dispensing portion 98 with a fluid communicaton channel 100 connecting base 96 and dispensing portion 98. Further, a dispensing opening 102 is shown in FIG. 9 for accessing fluid by the suckling infant. Similar to the nipples of FIGS. 3 and 6, the nipple is fabricated from suitable elastometric material such as thermoplastic rubber.

Nipple 42 may be maintained in a clean condition after fabrication by enclosure in a semi-rigid cover 50. Cover 50 typically is fabricated from semi-rigid materials and has a flange 51 which locks cover 50 to nipple assembly 95. The semi-rigid nature of cover 50 allows it to be removed when desired. Cover 50 is used to keep the nipple 42 isolated from unclean hands during the sliding movement of inner sleeve 40 towards spike 46, and typically axial pressure will be applied to cover 50 to force the axial movement of inner sleeve 40. Once diaphragm 44 has been penetrated by spike 46 to allow fluid to flow from compartment 34 to nipple 42, cover 50 may be removed and discarded. If the entire contents of the container are not dispensed to the nursing infant in a single feeding, cover 50 may be replaced over nipple 42 to keep it clean until further use is desired.

It is believed that the novel features of the present invention are set forth with particularity in the appended claims. However, it is intended that such changes and modifications which may be made in the preferred embodiments of the present invention and would be apparent to one skilled in the art and familiar with the teachings of this application would be encompassed in the scope of the claims.

What is claimed is:

1. A container for containing a fluid comprising:

at least one flexible wall defining an internal liquid compartment containing a quantity of liquid;

the flexible wall having a conduit extending therethrough the conduit having an inlet opening extending inside the container and an outlet opening which extends beyond the container;

the conduit having penetrable means located therein for closing the conduit; and rigid means for penetrating the penetrable means, said rigid means being secured to and located inside the container and aligned to penetrate said penetrable means upon movement of said rigid means and said penetrable means together, said rigid means including a conduit for allowing fluid from inside the container to flow into said conduit in said flexible wall and out a dispensing means secured to the outlet opening.

2. The container of claim 1 wherein the container is defined by at least one pair of generally opposed flexible walls, said pair of the flexible walls being joined along their periphery.

3. The container of claim 1 wherein said dispensing means comprises a nipple assembly having a flexible nipple portion including said outlet for dispensing liquid to a suckling infant.

4. The container of claim 1 wherein said penetrable means closing said conduit comprises a membrane intermediate said conduit inlet and outlet and closing fluid comnunication therebetween, said rigid means being aligned for axial movement in said fluid conduit to penetrate said membrane in response to movement of said membrane and rigid means together.

5. The container of claim 1 wherein said rigid means comprises:

means defining a generally elongated shaft terminating in a generally tapered end adapted to penetrate said penetrable means; and the conduit for allowing fluid to flow into the conduit in said flexible wall comprises at least one axially elongated flow passageway in said shaft adjacent said tapered end;

whereby liquid may flow readily through said flow passageway when said shaft end penetrates said penetrable means.

6. The container of claim 5 further including:

movement limiting means carried on said shaft, whereby said limiting means defined a maximum penetration of said penetrable means by said tapered end.

7. The container of claim 1 further including:

means defining a cover enclosing said dispensing means to maintain said dispensing means in a desired condition until use.

8. The container of claim 7 wherein said cover comprises two generally opposed sealing tabs, said tabs being separably sealed along their periphery to enclose said dispensing means.

9. The container of claim 8 wherein said container comprises at least a pair of opposed walls and wherein said sealing tabs comprise integral extensions of said flexible walls.

10. A container for containing a fluid comprising:

at least one flexible wall defining an internal liquid compartment containing a quantity of liquid, the flexible wall having a conduit extending therethrough, the conduit having an inlet opening extending inside the container and an outlet opening which extends beyond the container, the outlet opening is secured to a dispensing means for dispensing the fluid outside the container, the conduit having penetrable means located therein for closing the conduit; and an elongated rigid means for penetrating the penetrable means, said rigid means being supported by a semi-rigid support member located within the container, said rigid means is partially received by the conduit in said flexible wall so that the rigid means can penetrate the penetrable means upon movement of said rigid means and said penetrable means together, and said rigid means includes a conduit for allowing fluid from inside the container to flow into the conduit in said flexible wall.

11. The container of claim 10 wherein said container is defined by at least one pair of generally opposed flexible walls, said pair of flexible walls being joined along their periphery.

12. The container of claim 10 wherein said penetrable means closing said conduit comprises a membrane intermediate said conduit inlet and outlet and closing fluid communication therebetween, said rigid means being aligned for axial movement in said fluid conduit to penetrate said membrane in response to movement of said membrane and penetrating means together.

13. The container of claim 10 wherein said dispensing means comprises a nipple assembly having a flexible nipple portion including said outlet for dispensing said liquid to a suckling infant.

14. The container of claim 10 wherein said rigid means comprises:

means defining a generally elongated shaft terminating in a generally tapered end adapted to penetrate said penetrable means; and the conduit for allowing fluid from inside the container to flow into the conduit in said flexible wall comprises at least one axially elongated flow passageway in said shaft adjacent said tapered end, whereby liquid may flow readily through said flow passageway when said shaft end penetrates said penetrable means.

15. The container of claim 14 further including:

movement limiting means carried on said shaft, whereby said limiting means defines a maximum penetration of said penetrable means by said tapered end.

16. The container of claim 14 further including:

means defining a cover enclosing said dispensing means to maintain said dispensing means in the desired condition until use.

17. The container of claim 16 wherein said cover comprises two generally opposed sealing tabs, said tabs being sealed along their periphery to enclose said dispensing means.

18. The container of claim 17 wherein said container comprises at least a pair of opposed walls and wherein said sealing tabs comprise integral extensions of said flexible walls.

* * * * *